US006573870B1

(12) United States Patent
Chang

(10) Patent No.: US 6,573,870 B1
(45) Date of Patent: Jun. 3, 2003

(54) ANTENNA FOR USE OF PORTABLE WIRELESS COMMUNICATION SYSTEM

(76) Inventor: Eung-Soon Chang, 103-904 Samik Ceramic Apt., 1038 Mansoo-dong, Namdong-gu, Inchon-si, 405-240 (KR)

( * ) Notice: Subject to any disclaimer, the term of this patent is extended or adjusted under 35 U.S.C. 154(b) by 0 days.

(21) Appl. No.: 09/868,175

(22) PCT Filed: Nov. 30, 1999

(86) PCT No.: PCT/KR99/00721

§ 371 (c)(1),
(2), (4) Date: Jun. 15, 2001

(87) PCT Pub. No.: WO00/70707

PCT Pub. Date: Nov. 23, 2000

(30) Foreign Application Priority Data

May 13, 1999 (KR) ..... 99/17126

(51) Int. Cl.[7] ..... H01Q 1/24
(52) U.S. Cl. ..... 343/702; 343/895
(58) Field of Search ..... 343/702, 895, 343/725, 727; H01Q 1/24

(56) References Cited

U.S. PATENT DOCUMENTS 5,227,805 A * 7/1993 King et al. ..... 343/702
5,717,408 A 2/1998 Sullivan et al. ..... 343/702
5,859,617 A * 1/1999 Fujikawa ..... 343/702
6,285,340 B1 * 9/2001 Park et al. ..... 343/895
6,344,827 B1 * 2/2002 Wu ..... 343/702

FOREIGN PATENT DOCUMENTS

| | | |
|---|---|---|
| EP | 0736926 A1 | 10/1996 |
| JP | 9046117 | 2/1997 |
| JP | 9148825 | 6/1997 |

* cited by examiner

*Primary Examiner*—Hoanganh Le
(74) *Attorney, Agent, or Firm*—R. Neil Sudol; Coleman Sudol Sapone, P.C.

(57) ABSTRACT

An antenna for use in a portable wireless communication system in which the antenna is integral in its structure so as to function as a helical antenna when retracted and as a rod antenna when extended. A spring arranged in the helical antenna is formed as a leaf spring rolled to a thickness of 0.5 mm for enhancing bandwidth. A C-ring coupled to a lower end of the leaf spring has a circular configuration and is provided along its sides with a plurality of resilient plates inserted into a supporting member and contracted so that the antenna is resiliently fixed whether extended or retracted.

2 Claims, 5 Drawing Sheets

ANTENNA FOR USE OF PORTABLE WIRELESS COMMUNICATION SYSTEM

TECHNICAL FIELD

The present invention relates to a portable wireless communication system, and more particularly, to an antenna for use of portable wireless communication system in which configurations of a spring and a C-ring arranged in an interior of a helical antenna are enhanced so as to obtain an enhanced bandwidth, so that quality of communication may not be deteriorated by a frequency movement, so as to thereby allow the standing-wave ratio to approximate to a reference value with an enhanced impedance.

BACKGROUND ART

In general, wireless communication system adopts an antenna for performing wireless communications, wherein, through the antenna, a high frequency signal output from a modulation unit of the wireless communication system is transmitted and the thus-transmitted radio wave is received.

For an enhanced transmission and receipt characteristics of antenna, impedance of the antenna and that of the transmitter or receiver may be matched according to the transmitting or receiving frequency, and an unnecessary emission may be prevented, thereby reducing a power loss.

Such an antenna has a single unit configuration, so that it functions as a helical antenna when retracted and as a rod antenna when extracted.

In addition, the antenna accommodates in a lower portion thereof a spring to improve a receipt state.

FIG. 1 illustrates a conventional antenna unit of wireless communication system, wherein an antenna unit 20 includes a handle 21 to be used when extracting or retracting an antenna, an insulator unit 22, a helical antenna 23 to be coupled to a main body 10 so as to operate when the antenna is retracted and which is provided with a spring 25, and a Ni—Ti wire 24 to be coupled to the helical antenna 23 so as to function as an antenna when the antenna is extracted.

FIG. 2 illustrates a spring unit of a conventional antenna. In detail, FIG. 2 shows the spring 25 housed in the helical antenna 23, a metal rod 26 to which the spring 25 is to be coupled, and a rubber bobbin 27 which is to be inserted into the spring 25 so as to support the same, wherein one end of the spring 25 is inserted into the metal rod 26 by approximately 1 turn of the end of the spring 25.

FIG. 3 illustrates a cross cut portion 28 and a C-ring 29 of the conventional helical antenna 23.

DISCLOSURE OF INVENTION

Therefore, it is an object of the present invention to provide an antenna for use of wireless communication system in which a spring and a C-ring accommodated into a helical antenna have enhanced configuration.

To accomplish the above object of the invention, there is provided an antenna for use in wireless communication systems in which a spring housed in a helical antenna is made up of leaf spring rolled to a thickness of 0.5 mm and a C-ring formed of beryllium copper is heat-treated and pressed.

BRIEF DESCRIPTION OF DRAWINGS

The present invention will become more fully understood from the detailed description given hereinafter accompanying drawings, which are given by way of illustration only, and thus are not limitative of the present invention, and wherein.

BEST MODE FOR CARRYING OUT THE INVENTION

The present invention will be explained in more detail with reference to the attached drawings.

Figure 1:
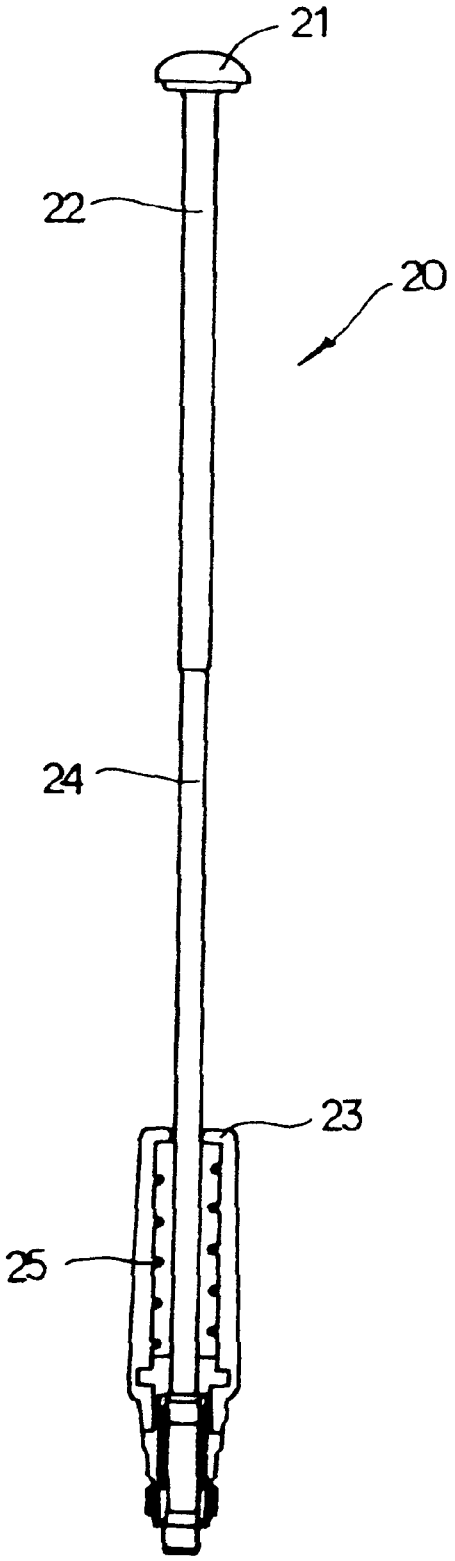
FIG. 1 illustrates a conventional antenna of a wireless communication system.
Figure 2:
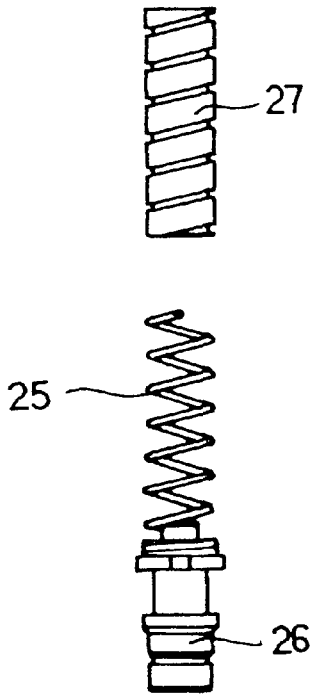
FIG. 2 illustrates a spring unit of a conventional antenna.
Figure 3:
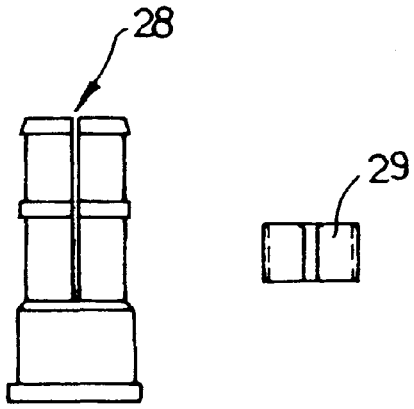
FIG. 3 illustrates a cross cut portion and a C-ring portion of a conventional antenna.
Figure 4:
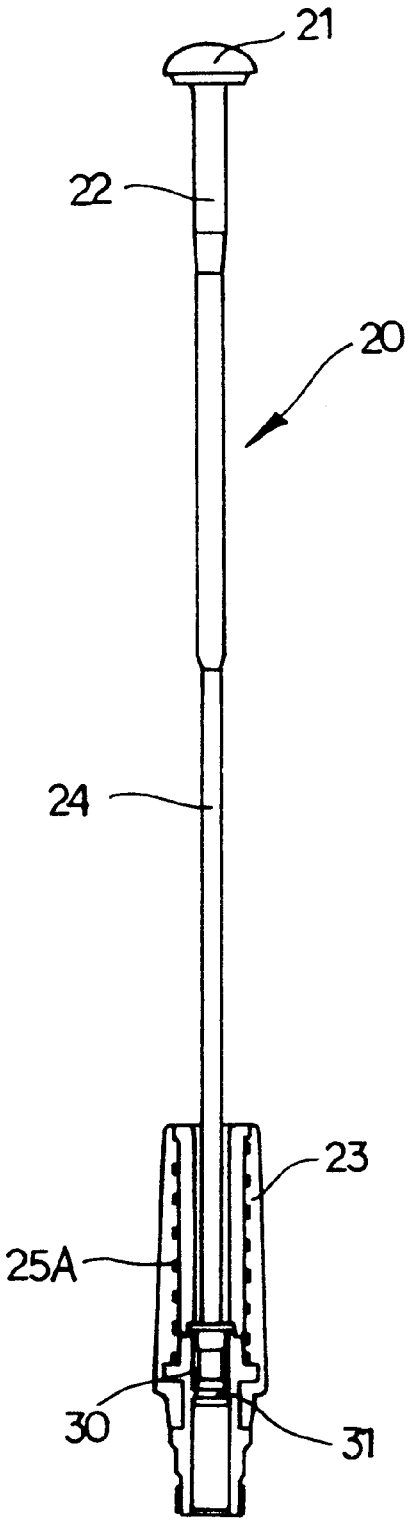
FIG. 4 illustrates an antenna of the present invention.

Referring to FIG. 4, the antenna unit 20 includes the handle 21, insulator unit 22, helical antenna 23, and Ni—Ti wire 24. A spring 25A is made up of a leaf spring, and the C-ring 30 is formed of pressed beryllium copper. Reference numeral 31 denotes a stopper.

Figure 5:
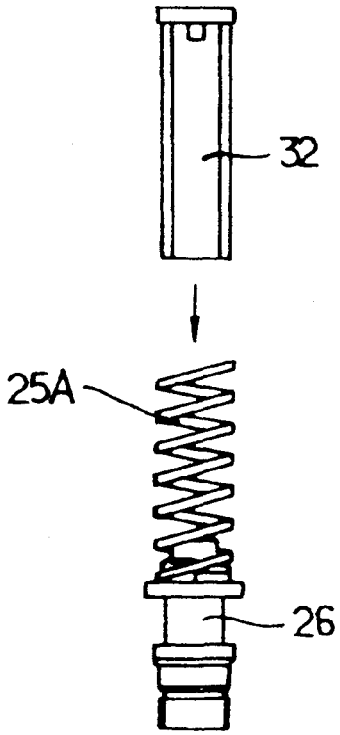
FIG. 5 illustrates a spring unit of the present invention.

FIG. 5 illustrates the spring unit inside of the helical antenna of the present invention, wherein one end of the spring 25A is inserted into the metal rod 26, a soldering is performed thereto, and a bobbin 32 is inserted therein.

Figure 6:
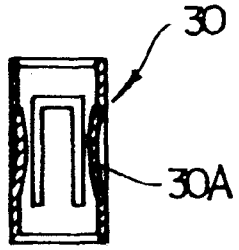
FIG. 6 illustrates a C-ring portion of the present invention.

FIG. 6 illustrates a configuration of the C-ring 30 of the present invention. Here, four resilient plates 30A for resiliently fixing the antenna when extracted or retracted from or to the main body are arranged at side surfaces of the C-ring 30.

Thus-configured antenna of the present invention operates as follows.

In an antenna of the present invention, the spring 25A is inserted into the metal rod 26 and soldered for a firm fixation.

The spring 25A is arranged to have an outer diameter by pitch (P=1.75) of 5.6 mm, and the spring 25A is wound by 6.0 turns so as to enhance characteristics of the antenna. Here, the spring 25A is a leaf spring rolled to a thickness of 0.5 mm.

Preferably, a heat-treated and pressed beryllium copper piece is used as the C-ring 30.

The C-ring 30 to be inserted into a lower interior of the spring 25A is formed into a circular shape provided at side surfaces thereof with a plurality of resilient plates 30A. Thus, the antenna may be firmly fixed by being resiliently supported by the resilient plates 30A when the antenna is extended, while the antenna may be firmly fixed to the main body by being resiliently supported by the resilient plates 30A when the antenna is retracted.

Figure 7:
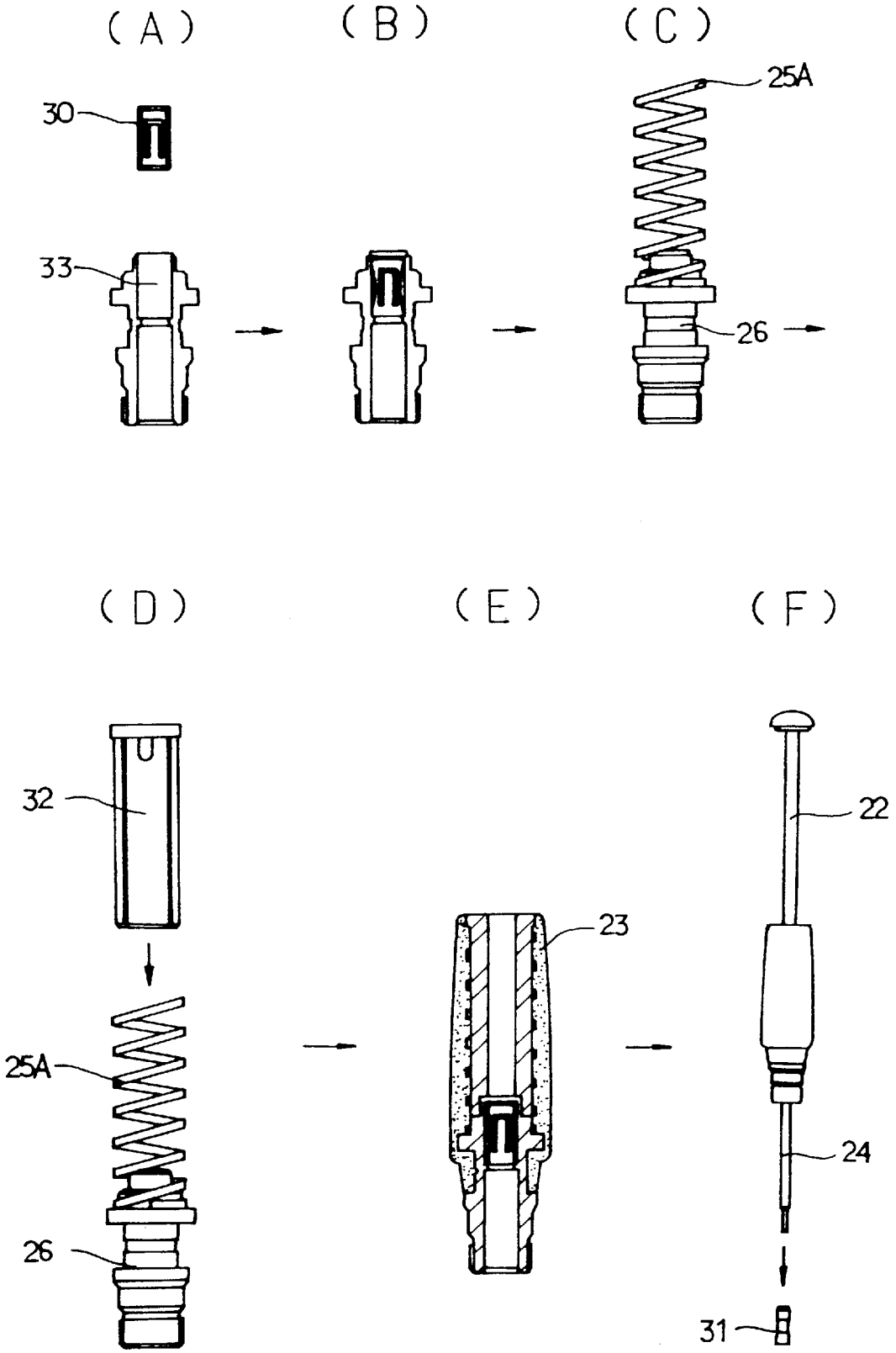
FIGS. 7A–7F illustrate an assembly process of an antenna of the present invention.

FIG. 7 illustrates an assembly process of the antenna of the present invention, wherein the C-ring 30 is inserted into a supporting member 33 as shown in (A), and contracted as shown in (B). Subsequently, the spring 25A is assembled to the supporting member 33 and soldered as shown in (C). Then, the bobbin 32 assembled downwardly to the supporting member 33 which is coupled to the spring 25A as shown in (D). Then, the supporting member 33 assembly is inserted into a pipe as shown in (E). Subsequently, a knob 22 is coupled to the pipe, and the stopper 31 is assembled to the Ni—Ti wire 24 and punched, thereby completing the process.

INDUSTRIAL APPLICABILITY

As described above, the present invention has advantage in that the spring arranged in a helical antenna is formed of a leaf spring so that antenna characteristics may be enhanced due to an expanded bandwidth. In addition, the C-ring arranged in the lower interior of the spring is formed of beryllium copper and pressed, thus a manufacturing cost may be curtailed with an enhanced product quality.

What is claimed is:

1. An antenna for use of portable wireless communication system in which said antenna has a single unit configuration so as to function as helical antenna when retracted and as a rod antenna when extended, and a spring arranged in said helical antenna is a leaf spring rolled to a thickness of 0.5 mm so as to expand bandwidth, and a C-ring to be coupled to a lower interior of said ring is shaped as a circle having at side surface thereof a plurality resilient plates, inserted into a supporting member and contracted so that an antenna is resiliently fixed when extended or retracted.

2. An antenna assembly for use in a portable wireless communication system, said antenna assembly having a single unit configuration so as to function as a helical antenna when retracted and as rod antenna when extended, said antenna assembly including a leaf spring rolled to a thickness of 0.5 mm for enhancing bandwidth, said antenna assembly further including a C-ring coupled to said spring at lower end thereof, said C-ring being formed at side surfaces with a plurality of resilient plates each fastened at a lower end to said C-ring and having a free upper end, said C-ring being inserted into a supporting member and contracted so that an antenna member is resiliently fixed when extended or retracted.

* * * * *